United States Patent [19]

Pflieger et al.

[11] 4,149,584

[45] Apr. 17, 1979

[54] INSTALLATION FOR THE MANUFACTURE OF WIRE BY PROJECTING A JET OF LIQUID METAL INTO A COOLING FLUID

[75] Inventors: Bernard Pflieger, Chamalieres; Andre Reiniche, Clermont-Ferrand, both of France

[73] Assignee: Compagnie Generale des Etablissements Michelin, Clermont-Ferrand, France

[21] Appl. No.: 842,898

[22] Filed: Oct. 17, 1977

[30] Foreign Application Priority Data

Oct. 15, 1976 [FR] France ..... 76 31801

[51] Int. Cl.[2] ..... B22D 11/124

[52] U.S. Cl. ..... 164/415; 164/423

[58] Field of Search ..... 164/66, 82, 259, 423, 164/415; 425/72 S

[56] References Cited

U.S. PATENT DOCUMENTS 3,070,839 1/1963 Thompson ..... 425/72 S 3,602,291 8/1971 Pond ..... 164/423

3,756,305 9/1973 Haussner ..... 164/259 X

*Primary Examiner*—Robert D. Baldwin

*Attorney, Agent, or Firm*—Brumbaugh, Graves, Donohue & Raymond

[57] ABSTRACT

An installation for the manufacture of wire by projecting a jet of liquid metal or metal alloy into a cooling fluid and having a crucible for containing the liquid metal or metal alloy and provided with at least one nozzle, means for exerting a pressure on the liquid metal or metal alloy sufficient to project it in the form of a jet through the nozzle into the cooling fluid, and a cooling enclosure for containing the cooling fluid and arranged at the outlet of the nozzle, is characterized by the fact that the cooling enclosure comprises, in the portion thereof adjacent to the nozzle, means for imparting to the cooling fluid a flow which is substantially transverse to the jet, at least over a length approximately equal to the length of the jet.

7 Claims, 4 Drawing Figures

INSTALLATION FOR THE MANUFACTURE OF WIRE BY PROJECTING A JET OF LIQUID METAL INTO A COOLING FLUID

This invention relates to improvements in installations intended for the manufacture of wire from a jet of liquid metal or metal alloy projected into a cooling fluid in which the liquid jet is transformed into solid wire.

Such installations comprise essentially:

—a crucible containing the metal or metal alloy melted by means of a heating element, and provided with at least one nozzle, —a means intended to exert on the molten metal or metal alloy the pressure necessary to project it in the form of a jet through the nozzle into a cooling fluid, —an enclosure, known as the cooling enclosure, containing a cooling fluid capable of transforming the jet into wire and arranged at the outlet of the nozzle, and —a device for receiving the wire at the outlet of the cooling enclosure.

When it is desired, with such installations, to obtain a wire which has satisfactory mechanical properties, in particular by the use of the process described in U.S. Pat. No. 3,861,452 in the case of steel, the jet must be projected at a relatively high speed. A long length of jet results from this. By length of jet there is understood the length of the liquid portion of the projected metal.

On the one hand, the increase in the length of the jet leads to an excessive elongation of the cooling enclosure. On the other hand, difficulties in take-up as well as defects and breaks of the wire increase. This is despite the use of cooling fluids at relatively low temperatures with such a composition as to have as high a cooling power as possible, and heat exchangers intended to maintain these fluids at relatively low temperatures.

The object of the present invention is, therefore, to make it possible, in installations of the type described, to increase the speed of projection of the jet so as to improve the properties of the wire while avoiding the drawbacks which would result from an increase in the length of the unsolidified jet.

Thus, the installation in accordance with the invention for the manufacture of wire by projecting a jet of liquid metal or metal alloy into a cooling fluid and having a crucible for containing the liquid metal or metal alloy and provided with at least one nozzle, a means for exerting a pressure on the liquid metal or metal alloy sufficient to project it in the form of a jet through the nozzle into the cooling fluid, and a cooling enclosure for containing the cooling fluid and arranged at the outlet of the nozzle, is characterized by the fact that the cooling enclosure comprises, in the portion thereof adjacent to the nozzle, means for imparting to the cooling fluid a flow which is substantially transverse to the jet, at least over a length approximately equal to the length of the jet.

In one preferred embodiment of the invention the inner wall of the portion of the cooling enclosure adjacent to the nozzle has the shape of a surface of revolution, for instance cylindrical, around an axis of revolution parallel to the axis of the nozzle, means being provided near said wall for imparting to the cooling fluid a movement of rotation around said axis of revolution.

For this purpose, a fan for propelling the cooling fluid can be arranged near said wall along a fan axis located at a distance other than zero from said axis of revolution. This distance is preferably between 50% and 100% of the distance from the surface of revolution to its axis of revolution.

Also, at least one tube for delivering the cooling fluid can be arranged near said wall along a tube axis located at a distance other than zero from said axis of revolution. This distance is preferably between 50% and 100% of the distance from the surface of revolution to its axis of revolution.

A third means of propelling the cooling fluid consists in using at least one tube for delivering steam along a tube axis located at a distance other than zero from said axis of revolution and arranged near said wall of the cooling enclosure, and using at least one other time similarly located for delivering a gas or a gaseous mixture (hydrogen, nitrogen, argon, helium) into the cooling enclosure, this gas or gaseous mixture being at a temperature below the condensation point of the steam. The said distance for the steam tube and for the gas tube is preferably between 50% and 100% of the distance from the surface of revolution to its axis of revolution.

On the one hand, the expansion of the steam in the gas imparts to the cooling fluid a movement of rotation around the axis of revolution of said portion of the cooling enclosure. On the other hand, droplets produced by the condensation of the steam in the gas or gaseous mixture and entrained by the gas or gaseous mixture flow transversely to the jet, providing additional cooling for the latter.

A preferred embodiment of these various propulsion means consists—within the scope of the process described in U.S. Pat. No. 3,861,452 for the manufacture of wires from steel having a content of silicon and possibly of manganese by means of an installation of the type in question—in using hydrogen or a mixture of hydrogen and nitrogen as the gas.

Furthermore, whatever the means employed for the propulsion of the cooling fluid, it is advantageous, in order to achieve optimum cooling of the wire, that the angle formed by the axis along which the means of propulsion acts with the axis of revolution of the surface of revolution be adjustable in space.

Nonlimitative embodiments of the invention are illustrated by the drawing in which.

Figure 1:
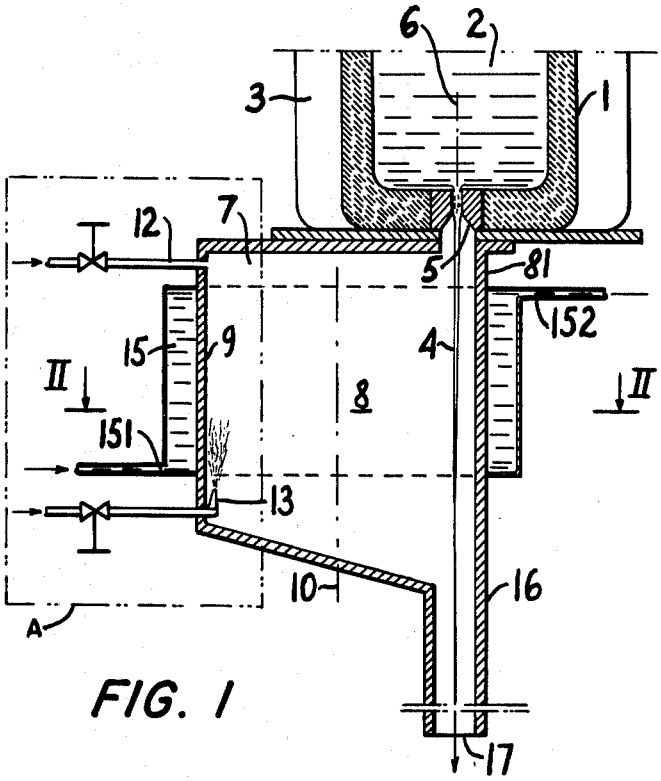
FIG. 1 is a schematic elevational view in cross section of an installation in accordance with the invention.

FIG. 1 shows part of an installation in accordance with the invention. The crucible 1 contains molten or liquid metal 2 and is surrounded by a pressurization enclosure 3, only the lower part of which is shown. The pressurization enclosure 3 contains a gas under a pressure suitable to project the jet 4 through the nozzle 5 of vertical axis 6 arranged in the bottom of the crucible 1 into the cooling fluid 7 contained in the cooling enclosure 8 arranged at the outlet of the nozzle 5.

The cooling enclosure 8 comprises a first element 81 behind the nozzle 5. The inner wall 9 of this element 81 is, in accordance with the invention, a cylinder of revolution around the axis 10 parallel to the extension into the cooling enclosure 8 of the axis 6 of the nozzle 5. The distance l from the extension of the axis 6 of the nozzle 5, that is to say the jet 4, to the cylinder wall 9 is less than the distance L between the jet 4 and the axis 10 of the cylinder wall 9. The length of the part 81 is about that of the jet 4, that is to say of the liquid portion of the metal projected.

Figure 2:
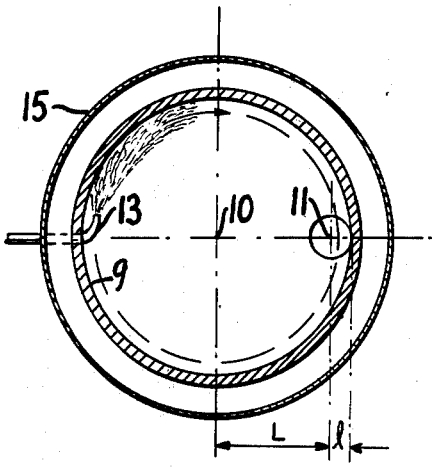
FIG. 2 is a cross-sectional view taken on line II—II of FIG. 1 through the cooling enclosure along a plane perpendicular to the axis of the surface of revolution forming the inner wall of the cooling enclosure.

As indicated in FIG. 2, the cooling fluid 7 is imparted a movement of rotation around the axis 10 of the cylinder wall 9. For this purpose, a tube 13 delivering steam is arranged near the cylinder wall 9 and oriented, on the one hand, along an axis located at a distance other than zero from the axis 10 of the cylinder wall 9. The rotation of the cooling fluid 7 around the axis 10 is thus brought about. On the other hand, the tube 13 forms an adjustable angle of between 0° and 90° with the axis 10 of the cylinder wall 9, which makes it possible to optimize the cooling of the jet 4.

Thus, the steam follows a helicoidal path in the direction towards the orifice of the nozzle 5. Finally, a jacket 15, fed at the bottom 151 with cooled water and evacuated at the top 152, surrounds the cylinder wall 9. The temperature of the moving cooling fluid 7 in the cooling enclosure 8 is thus further lowered.

The cooling enclosure 8 comprises a second element 16, connected as a continuation of the first element 81. This element 16 has the shape of a channel centered on the axis 6 of the nozzle 5 and via the lower end orifice 17 of which the cooling enclosure 8 communicates with the ambient air.

In the example described, the progression of the jet 4 in the cooling fluid 7 takes place parallel to the descendant vertical. However, the cooling enclosure 8 in accordance with the invention operates whatever the orientation of the jet 4 in space, provided that the axis 6 of the nozzle 5 remains parallel to the axis of revolution 10.

Such an installation, for a jet 4 of liquid steel at 1500° C. of a diameter of $165\times10^{-6}$m projected at a speed of 15 m/second, gives a length of jet 4 of 0.3 m, instead of 0.44 m, the length of the cooling enclosure 8 being 1.6 m in both cases. The movement of rotation of the cooling fluid 7 is obtained in a cylinder 9 with a radius (L+l) of 150 mm. The distance L is equal to 100 mm and the height H of the cylinder 9 is equal to 350 mm. The rates of flow are as follows:

—hydrogen ($H_2$): 25 liters/minute; temperature: 20° Celsius;

—steam: 0.08 kg/minute; temperature: 125° Celsius.

The tube 13 is oriented tangentially to the movement of rotation of the cooling fluid 7 and forms an angle equal to +30° in the direction of the nozzle 5 with the axis of revolution 10. The distance between the axis of the tube 13 and the axis 10 of the cylinder 9 is 140 mm.

An installation without the arrangements in accordance with the invention does not permit the production of wire. Thus, such a wire would emerge from the cooling enclosure 8 at a temperature of 1150° C. and burn at the level of the orifice 17. However, with an installation in accordance with the invention, the wire emerges from the cooling enclosure 8 at a temperature of 700° C. It is without trace of iron oxide and is free of defects and breaks.

Figure 3:
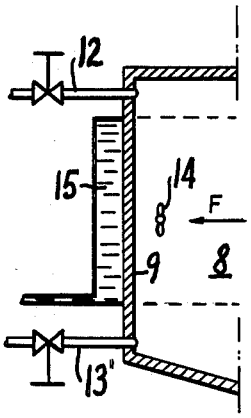
FIG. 3 is a schematic elevational view in cross section of an installation similar to that of FIG. 1 but provided with a fan for the circulating of the cooling fluid.
Figure 4:
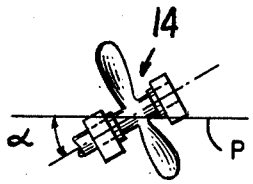
FIG. 4 is an elevational view of the fan shown in FIG. 3, on a larger scale and in the direction indicated by the arrow F in FIG. 3.

FIG. 3 is a view of the part of FIG. 1 contained within the rectangle A drawn in dot-dash line, in order to show a variant embodiment of this portion of the installation. Differing from what was shown in FIG. 1, the feed of steam takes place here through an unbent tube 13' and the feed of gas or gaseous mixture is through tube 12 (as also in FIG. 1). In order to impart a movement of rotation, as in the example of FIGS. 1 and 2, to the cooling fluid 7 contained in the cooling enclosure 8, use is made, in this variant, of a fan 14 which is installed near the cylinder wall 9 of the cooling enclosure 8. As can be noted from FIG. 4, the axis of rotation of this fan 14 forms an angle α of about 30° with the trace of a plane P perpendicular to the axis 10 of the cylinder 9. This fan 14 is driven in rotation by a motor (not shown).

Such a fan could be installed in the same way in the apparatus shown in FIGS. 1 and 2.

What is claimed is:

1. An installation for the manufacture of wire by projecting a jet of liquid metal or metal alloy into a cooling fluid and having a crucible for containing the liquid metal or metal alloy and provided with at least one nozzle, means for exerting a pressure on the liquid metal or metal alloy sufficient to project it in the form of a jet through the nozzle into the cooling fluid, and a cooling enclosure for containing the cooling fluid and arranged at the outlet of the nozzle, characterized by the fact that the inner wall of the portion of the cooling enclosure adjacent to the nozzle has the shape of a surface of revolution around an axis of revolution parallel to the axis of the nozzle, means being provided near said wall for imparting to the cooling fluid a movement of rotation around said axis of revolution, said movement being substantially transverse to the jet, at least over a length approximately equal to the length of the jet.

2. The installation according to claim 1, characterized by the fact that a fan for propelling the cooling fluid is arranged near said wall along a fan axis located at a distance other than zero from said axis of revolution.

3. The installation according to claim 1, characterized by the fact that at least one tube for delivering the cooling fluid is arranged near said wall along a tube axis located at a distance other than zero from said axis of revolution.

4. The installation according to claim 1, characterized by the fact that at least one tube for delivering steam is arranged near said wall along a tube axis located at a distance other than zero from said axis of revolution and at least one other tube is similarly located for delivering a gas or a gaseous mixture into the cooling enclosure, said gas or gaseous mixture being at a temperature below the condensation point of the steam.

5. The installation according to claim 4 for the manufacture of steel wire by projecting a jet of liquid steel into a cooling fluid, said steel having a content of silicon and possibly of manganese such that, upon contact with an oxygen-donor cooling fluid, the first oxidation product forming on the jet is silica, the other tube delivering hydrogen as the gas or a mixture of hydrogen and nitrogen as the gaseous mixture.

6. The installation according to claim 2, characterized by the fact that said distance other than zero is between 50% and 100% of the distance from the surface of revolution to its axis of revolution.

7. The installation according to claim 2, characterized by the fact that the axis located at a distance other than zero from the axis of revolution forms an angle which is adjustable in space with said axis of revolution.

* * * * *